US007383773B2

(12) United States Patent
Kiesche

(10) Patent No.: US 7,383,773 B2
(45) Date of Patent: Jun. 10, 2008

(54) APPARATUS FOR DEFLECTING INDIVIDUAL WEBS

(75) Inventor: Herbert Kiesche, Friedberg (DE)

(73) Assignee: MAN Roland Druckmachinen AG, Offenbach (DE)

( * ) Notice: Subject to any disclaimer, the term of this patent is extended or adjusted under 35 U.S.C. 154(b) by 0 days.

(21) Appl. No.: 11/085,979

(22) Filed: Mar. 22, 2005

(65) Prior Publication Data

US 2005/0229798 A1 Oct. 20, 2005

(30) Foreign Application Priority Data

Mar. 22, 2004 (DE) ..... 10 2004 014 266

(51) Int. Cl.
*B41F 13/54* (2006.01)

(52) U.S. Cl. ..... 101/228; 226/27; 226/34; 226/15; 226/24; 101/219

(58) Field of Classification Search ..... 101/228, 101/227, 226, 225, 216, 219; 226/196, 91, 226/109, 189, 110, 15, 24, 27, 28, 34, 35; 242/332, 615.11, 615.21, 596.3
See application file for complete search history.

(56) References Cited

U.S. PATENT DOCUMENTS 2,366,331 A * 1/1945 Harless ..... 101/227
3,734,487 A * 5/1973 Treff ..... 270/52.08
5,284,088 A * 2/1994 Fantoni et al. ..... 101/228
5,357,859 A * 10/1994 Eckert ..... 101/228
5,996,491 A * 12/1999 Kishine et al. ..... 101/223
6,450,382 B1 * 9/2002 Ohno ..... 226/21
6,695,250 B2 * 2/2004 Michalik et al. ..... 242/615.21
6,820,839 B2 * 11/2004 Weis ..... 242/615.21
2002/0124704 A1 * 9/2002 Roth ..... 83/436.5
2002/0195009 A1 * 12/2002 Boucher ..... 101/228
2003/0047644 A1 * 3/2003 Michalik et al. ..... 242/615.21

FOREIGN PATENT DOCUMENTS

GB 2171084 A * 8/1986

* cited by examiner

*Primary Examiner*—Ren Yan
*Assistant Examiner*—Matthew G Marini
(74) *Attorney, Agent, or Firm*—Leydig, Voit & Mayer, Ltd

(57) ABSTRACT

An apparatus for deflecting a printing material web coming from a printing press that is cut into at least two individual webs to laterally arranged processing devices. The apparatus includes a respective load-bearing frame for each individual web. A respective deflection rod and a respective longitudinal regulation roller for each individual web is supported on the load bearing frame. The deflection rods and longitudinal regulation rollers are adjustable relative to the load-bearing frame in a direction transverse to or parallel to a running direction of the respective individual web.

11 Claims, 3 Drawing Sheets

APPARATUS FOR DEFLECTING INDIVIDUAL WEBS

FIELD OF THE INVENTION

The invention relates to an apparatus for deflecting a printing material web.

BACKGROUND OF THE INVENTION

A deflection apparatus can be used to defect a printing material web, which comes from a printing press and is cut into two or more individual webs, to laterally arranged processing devices. Such deflection apparatuses can include deflection rods. Unfortunately with some deflection apparatuses it can be difficult to adjust the running paths of the individual webs into different positions. Another issue is that some deflection apparatuses take up a relatively large amount of space.

BRIEF SUMMARY OF THE INVENTION

A general object of the present invention is providing a printing material web deflecting apparatus that ensures that the setting of the running paths of the individual webs is highly flexible and that has a compact construction.

According to the invention, a deflection rod and a longitudinal regulation roller are arranged for each individual web in a manner such that the deflection rod and regulation roller are attached to a common load-bearing frame. The deflection rod and regulation roller are further arranged such that they can be adjusted with regard to the load-bearing frame in a transverse direction and/or in a parallel direction relative to the running direction of the arriving individual web. Moreover, only relatively short deflection rods are required as a result of this arrangement. Guide rollers can also be adjustably supported on the load-bearing frame.

According to one embodiment of the invention, the load-bearing frames for the different individual webs are arranged at heights that are offset with respect to one another. This arrangement provides the machine operator with good accessibility.

DETAILED DESCRIPTION OF THE INVENTION

Figures 1, 2:
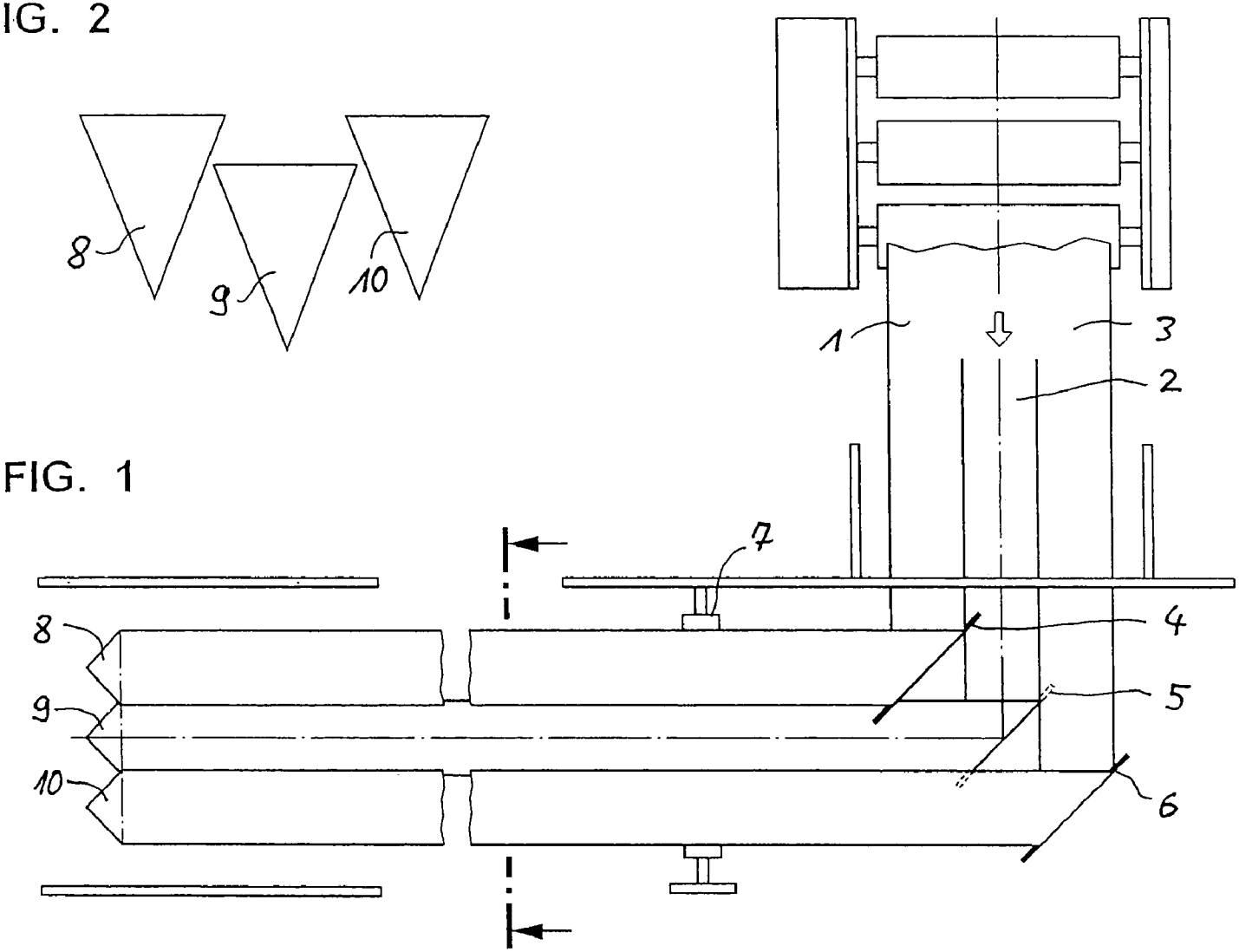
FIG. 1 is a schematic plan view of an exemplary apparatus for deflecting individual webs according to the present invention.
FIG. 2 is a schematic view of the folding formers of the deflection apparatus of FIG. 1.

A deflection apparatus that is fed a printing material web which has been cut into three individual webs 1, 2, 3 is illustrated in FIG. 1. Each of the webs 1, 2, 3 is deflected at right angles via a respective deflection rod 4, 5, 6 and runs to a respective folding former 8, 9, 10 via a fixedly supported drawing roller 7. As shown in FIG. 2, the folding formers 8 and 10 are arranged at a height that is offset from the height of the folding former 9. Additionally, the upper corners of the folding former 9 overlap with the facing sides of the folding formers 8 and 10. As the folding formers are configured to be somewhat wider than the maximum width of the individual webs which are to be folded, this arrangement allows for feeding the individual webs to the folding formers directly next to one another.

Figure 3:
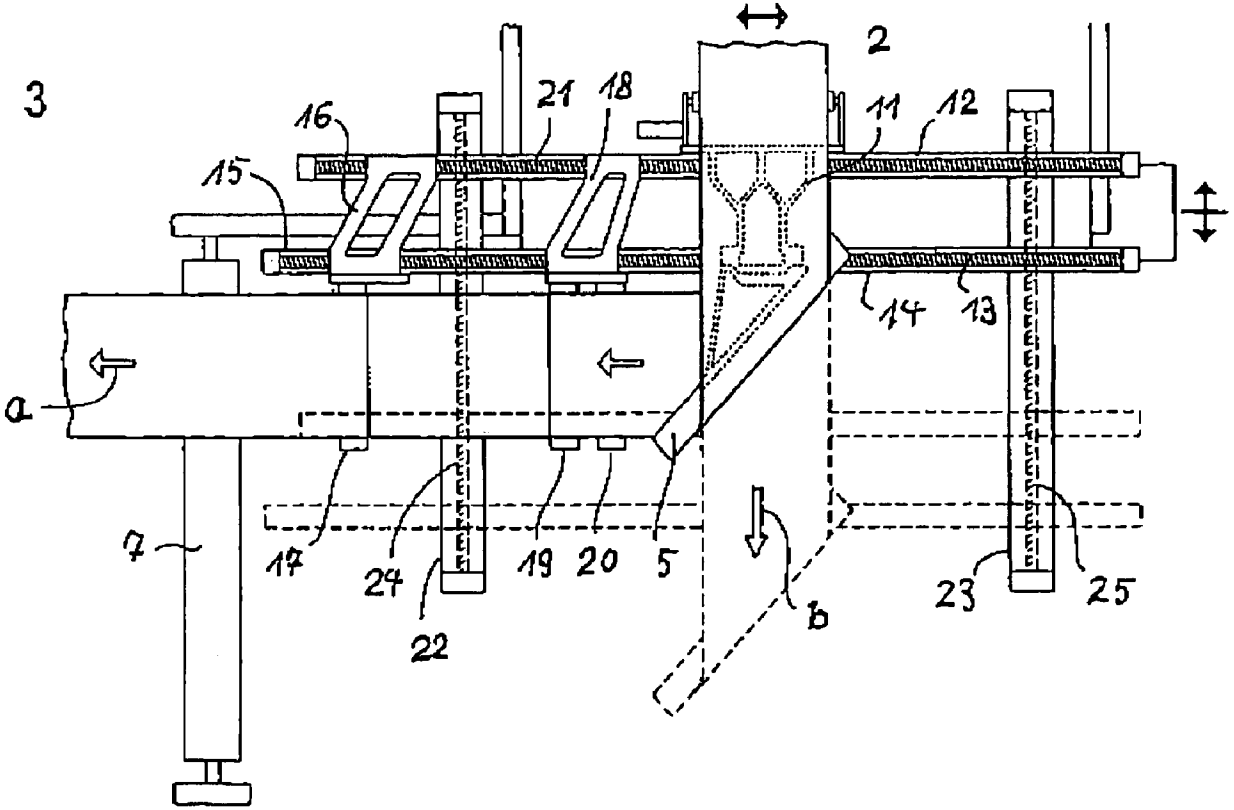
FIG. 3 is a schematic plan view of the deflection rod for an individual web of the deflection apparatus of FIG. 1 that can be adjusted in two directions.

The arrangement of the deflection rod 5 for the individual web 2 is shown in FIG. 3. The arrangement includes two load-bearing rails 12, 14 that, in this case, comprise a load-bearing frame. The deflection rod 5 is seated on a carrier 11 (shown by dashed lines). The carrier 11 is movably guided on the load-bearing rail 12 on one side. On the other side, the carrier 11 is drivably connected to an adjusting element 13 that is mounted on the load-bearing rail 14. A further adjusting element 15 is arranged on the load-bearing rail 14. The adjusting element 15 is drivably connected to a carrier 16. The carrier 16 is movably guided on the load-bearing rail 12 and supports a linear regulation roller 17. A further carrier 18 bears two guide rollers 19, 20. In this case, the carrier 18 is drivably connected to an adjusting element 21.

This arrangement enables independent adjustment of the carrier 11 for the deflection rod 5, the carrier 16 for the linear regulation roller 17, and the carrier 18 for the two guide rollers 19, 20 in the running direction of the individual web 2 (designated by a). In the illustrated embodiment, the adjusting elements are configured as threaded spindles each of which is driven by a motor (not shown). However, the adjusting elements also can be configured as adjusting rods that have one end pivotably connected to a carrier and a second end that can be moved via a toothed rack in or counter to the direction of the arrow a by means of a motor. Endless toothed belts that are connected to the carriers and can be moved by means of respective motors are another alternative for the design of the adjusting elements.

Figure 4:
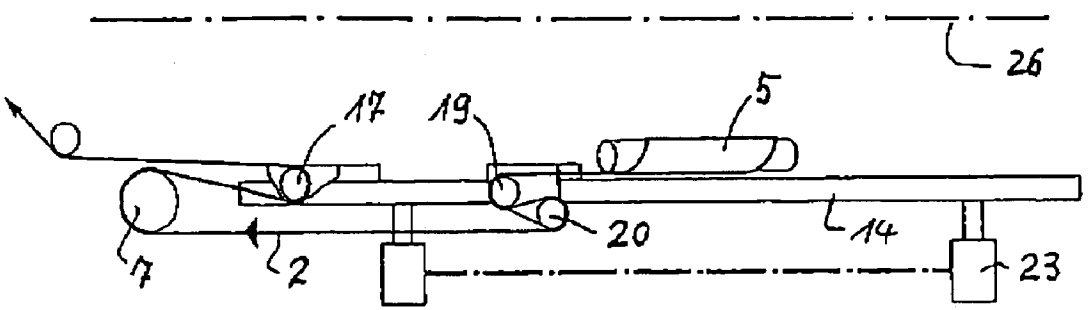
FIG. 4 is schematic side view of the deflection rod of FIG. 3.

As shown in FIG. 4, the individual web 2 runs in an S-shaped loop from the deflection rod 5 via the guide rollers 19, 20 to the fixedly arranged, driven drawing roller 7, and subsequently further via the linear regulation roller 17 to the processing device. The guide rollers 19, 20 can be omitted if the running path of the individual web 2 to the drawing roller 7 is relatively short. The drawing roller also can be configured as an un-driven guide roller. As shown in FIGS. 1 and 2, the processing device can consist of a folding former or a plough fold.

In contrast to the adjusting elements, the two load-bearing rails 12, 14 extend completely through the entire arrangement. The adjusting elements 13, 15 and 21, each of which is assigned to a respective carrier 11, 16, 18, extend only over part of the length of the load-bearing rails. In this case, each threaded spindle engages teeth that are fixed to the respective carrier.

For the additional adjustment of the deflection rod 5 and the rollers 17, 19 and 20 in the direction of the arrow b (i.e., in the running direction of the arriving individual web 2), two fixedly arranged load-bearing rails 22, 23 are provided in the illustrated embodiment. An adjusting element 24, 25 is mounted on each of the load-bearing rails 22, 23. The adjusting elements 24, 25 are again configured as threaded spindles and can be synchronously driven by means of motors (not shown). Each of the adjusting elements 24, 25 is drivably connected to the two load-bearing rails 12, 14. Therefore, synchronous movement of the adjusting elements 24, 25 brings about movement of the load-bearing rails 12, 14 in or counter to the direction of the arrow b, as indicated by dashed lines.

The adjusting arrangement for the deflection rods 4 and 6 is also configured as has been previously described. In order to achieve satisfactory accessibility for an operator, the deflection rods 4 and 6 are arranged at a height offset relative to the height of the turning rod 5. In this instance, the position of the load-bearing rails for the deflection rod 4 is indicated by the dash-dotted line 26. The deflection rod 6 is correspondingly arranged relatively lower.

Figures 5, 6:
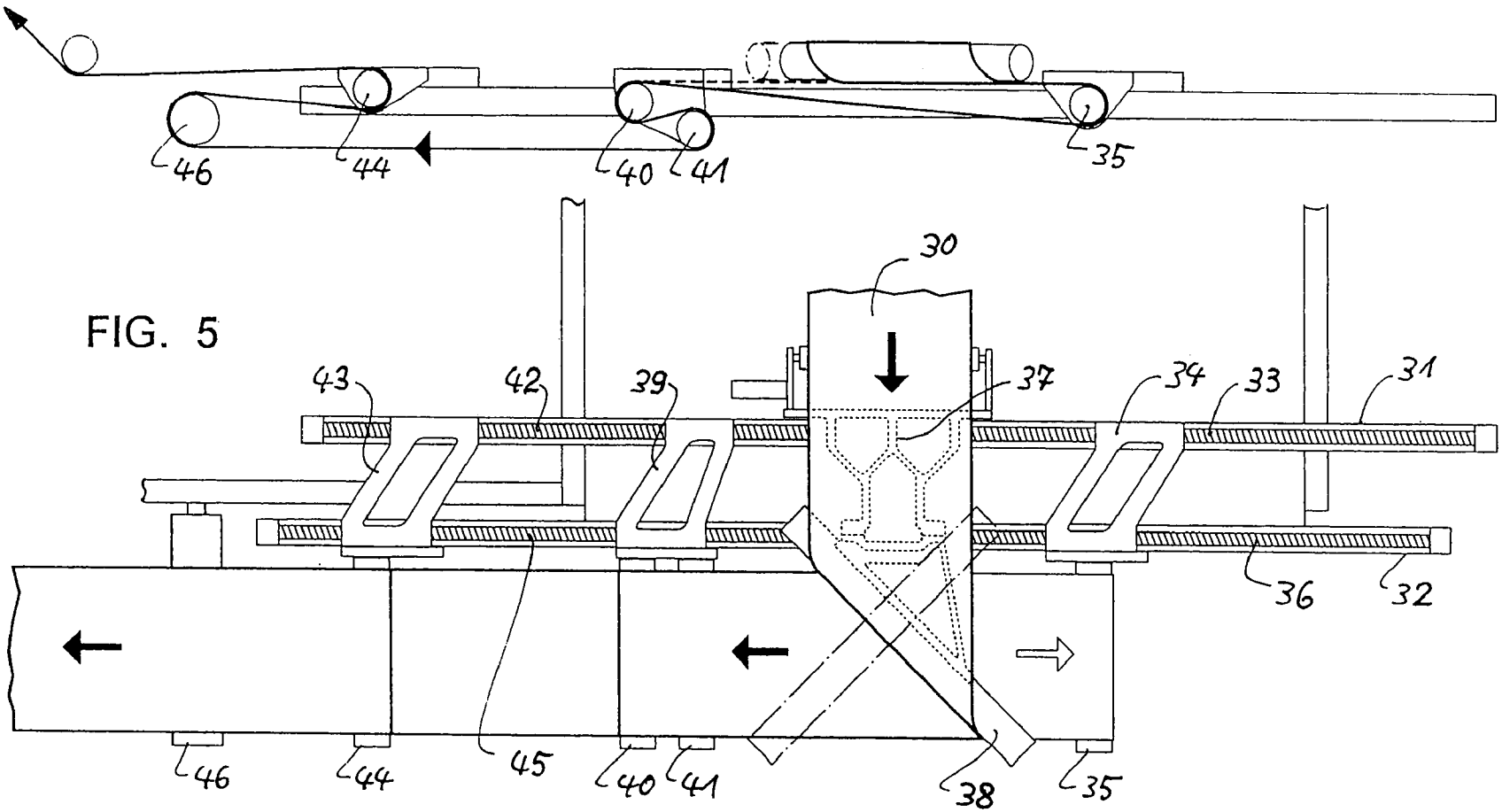
FIG. 5 is a schematic plan view of an alternative embodiment of a deflection apparatus according to the invention which can be adjusted in one direction and has a turning function.
FIG. 6 is a schematic side view of the deflection apparatus of FIG. 5.

The embodiment shown in FIGS. 5 and 6 enable the turning of an arriving individual web 30. The FIGS. 5 and 6 embodiment again has a load-bearing frame with two continuous load-bearing rails 31, 32. An adjusting element 33 that is configured as a threaded spindle is mounted on the load-bearing rail 31. A carrier 34 is drivably connected to the adjusting element 33. The carrier 34 is movably guided on the other load-bearing rail 32 and supports a reversing roller 35.

A further adjusting element 36, which is drivably connected to a carrier 37 for a deflection rod 38, is guided on the load-bearing rail 32. A carrier 39 for two guide rollers 40, 41 is drivably connected to an adjusting element 42 which is mounted on the load-bearing rail 31. In this instance, the carrier 39 is guided on the load-bearing rail 32 so as to be freely displaceable. A further carrier 43 for a linear regulation roller 44 is drivably connected to an adjusting element 45 on the load-bearing rail 32 and is guided on the load-bearing rail 31 so as to be freely displaceable. As the deflection roller 35 can be adjusted in or counter to the running direction of the diverted individual web 30, the deflection roller 35 also can assume the function of the linear regulation roller 44. In this case, this type of apparatus is provided for each individual web to be deflected.

In the apparatus according to FIGS. 5 and 6, the arriving individual web 30 initially runs around the deflection rod 38 to the reversing roller 35. From the reversing roller 35, the web passes to the guide rollers 40, 41, loops around them in an S shape and then runs on to a drawing roller 46. Subsequently, the web runs around the linear regulation roller 44 and then to the respective processing device.

If required, it is also possible for the load-bearing rails 31, 32 in the embodiment of FIGS. 5 and 6 to be additionally arranged so as to be displaceable in or counter to the running direction of the arriving web 30, as in the embodiment of FIGS. 1-4. According to a further embodiment, the carriers can be arranged so as to be adjustable only parallel to the running direction of the arriving web.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A deflecting apparatus for deflecting a printing material web coming in a running direction from a printing press that is cut into at least two individual webs and is directed in a second direction at an angle to said running direction from the printing press to laterally arranged processing devices, the deflecting apparatus comprising:

a respective load-bearing frame for each individual web; and a respective deflection rod and a respective longitudinal regulation roller for each individual web supported on the corresponding load bearing frame, and the deflection rods and longitudinal regulation rollers being adjustably positionable relative to the load-bearing frame in a direction parallel and a direction transverse to the running direction of the respective individual web.

2. The deflecting apparatus according to claim 1, further including guide rollers that are adjustably mounted on each load-bearing frame.

3. The deflecting apparatus according to claim 1, wherein the load-bearing frames for the different individual webs are arranged at heights that are offset with respect to one another.

4. The deflecting apparatus according to claim 1, wherein each load-bearing frame comprises two parallel load-bearing rails.

5. The deflecting apparatus according to claim 4, wherein each individual web has a corresponding carrier for the respective deflection rod and the respective longitudinally regulation roller, the carrier being movably supported on the load-bearing rails.

6. The deflecting apparatus according to claim 5, wherein each carrier is guided on one load-bearing rail so as to be freely displaceable and each carrier is drivably connected to an adjusting element that is guided parallel to the other load-bearing rail.

7. The deflecting apparatus according to claim 5, wherein the load-bearing frame supporting the displaceable carriers is adjustable in the direction parallel to the running direction of the individual web by a pair of adjusting elements that are arranged in parallel relation.

8. The deflecting apparatus according to claim 7, wherein the adjusting elements comprise threaded spindles.

9. The deflecting apparatus according to claim 1, wherein for each individual web the deflection rod is provided on the corresponding load-bearing frame for turning the respective individual web, the deflection rod being arranged in a turning position for turning the respective individual web toward a downstream reversing roller that is arranged on a carrier.

10. The deflecting apparatus according to claim 1, further including for each individual web a fixed drawing roller arranged in the running path of the respective individual web between the corresponding deflection rod and the corresponding linear regulation roller.

11. The deflecting apparatus according to claim 1 in which said respective deflection rod and longitudinal regulation roller for each individual web are adjustably positionable relative to the load bearing frame in a direction transverse to the running direction of the respective individual web.

* * * * *